US011768048B1

(12) United States Patent
Noonan

(10) Patent No.: US 11,768,048 B1
(45) Date of Patent: Sep. 26, 2023

(54) FIRE CONTROL ASSEMBLY AND METHOD OF MANUFACTURING IT

(71) Applicant: F.M. Products Inc, Boise, ID (US)

(72) Inventor: Paul T. Noonan, Boise, ID (US)

(73) Assignee: F.M. Products, Inc, Boise, ID (US)

( * ) Notice: Subject to any disclaimer, the term of this patent is extended or adjusted under 35 U.S.C. 154(b) by 0 days.

(21) Appl. No.: 17/516,983

(22) Filed: Nov. 2, 2021

Related U.S. Application Data

(60) Provisional application No. 63/109,238, filed on Nov. 3, 2020.

(51) Int. Cl.
*F41A 17/46* (2006.01)

(52) U.S. Cl.
CPC ..... *F41A 17/46* (2013.01)

(58) Field of Classification Search
CPC ..... F41A 17/46
See application file for complete search history.

(56) References Cited

U.S. PATENT DOCUMENTS

| | | | | |
|---|---|---|---|---|
| 9,557,128 | B2 * | 1/2017 | Miller, III | F41A 17/46 |
| 9,784,518 | B2 * | 10/2017 | Geissele | F41A 19/46 |
| 10,466,002 | B1 * | 11/2019 | Geissele | F41A 19/02 |
| 10,746,489 | B1 * | 8/2020 | Huang | F41A 17/46 |
| 11,340,034 | B1 * | 5/2022 | Yudys | F41A 35/06 |
| 2005/0241470 | A1 * | 11/2005 | Hochstrate | F41A 19/46 89/142 |
| 2020/0116448 | A1 * | 4/2020 | Zung | F41A 17/56 |
| 2022/0107150 | A1 * | 4/2022 | Lipowski | F41A 17/00 |

* cited by examiner

*Primary Examiner* — Joshua E Freeman

(57) ABSTRACT

A fire control assembly is disclosed. The fire control assembly contains a pivotable shaft containing a first end and a second end and a first selector member removably coupled with the first end of the pivotable shaft, wherein the first selector contains a first protrusion configured to partially envelop the first end of the pivotable shaft; wherein the first selector member is configured to rotate the pivotable shaft from a safe position to a firing position and back to the safe position.

8 Claims, 10 Drawing Sheets

FIRE CONTROL ASSEMBLY AND METHOD OF MANUFACTURING IT

CROSS REFERENCE TO RELATED APPLICATIONS

This application claims the benefit of U.S. Provisional Application No. 63/109,238, filed on Nov. 3, 2020, which is incorporated herein by reference in its entirety.

FIELD

The present invention relates to firearm manufacture. More particularly, the present invention relates to a fire control assembly and a method of manufacturing it.

BACKGROUND

The safety selector in a common AR15-type semi-automatic firearm operates by rotation of a lever from a "safe" position to the "fire" position. In the "safe" position, the safety selector blocks movement of the trigger member. When rotated to the "fire" position, the safety selector allows movement of the trigger. The safety selectors known in the art are expensive to produce and may not be reliable when being rotated from "safe" position to "fire" position. Therefore a need exists for a better type of safety selector for firearms.

DETAILED DESCRIPTION

Figure 1:
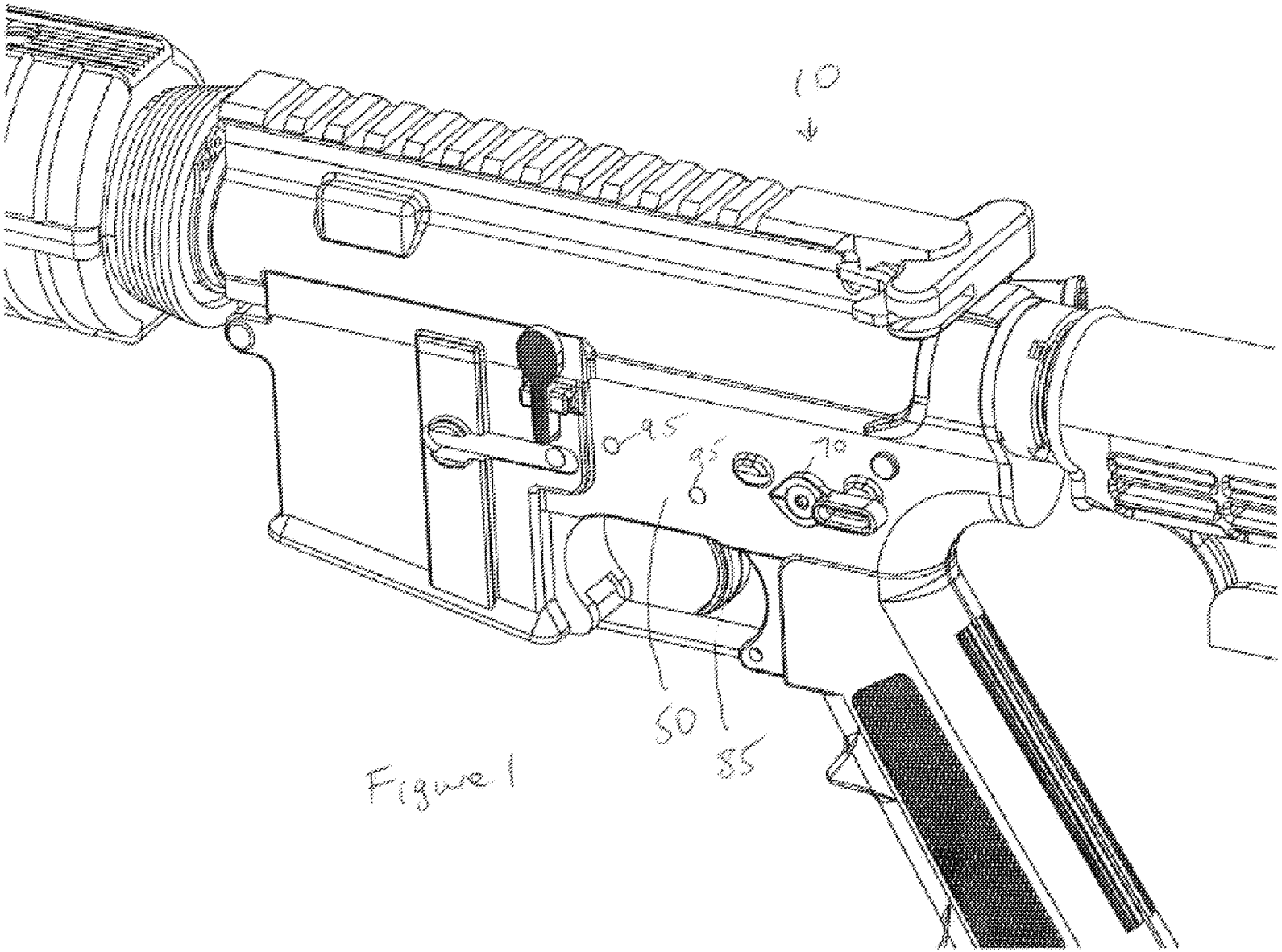
FIG. 1 depicts a partial view of a firearm according to some embodiments presently disclosed.
Figure 2:
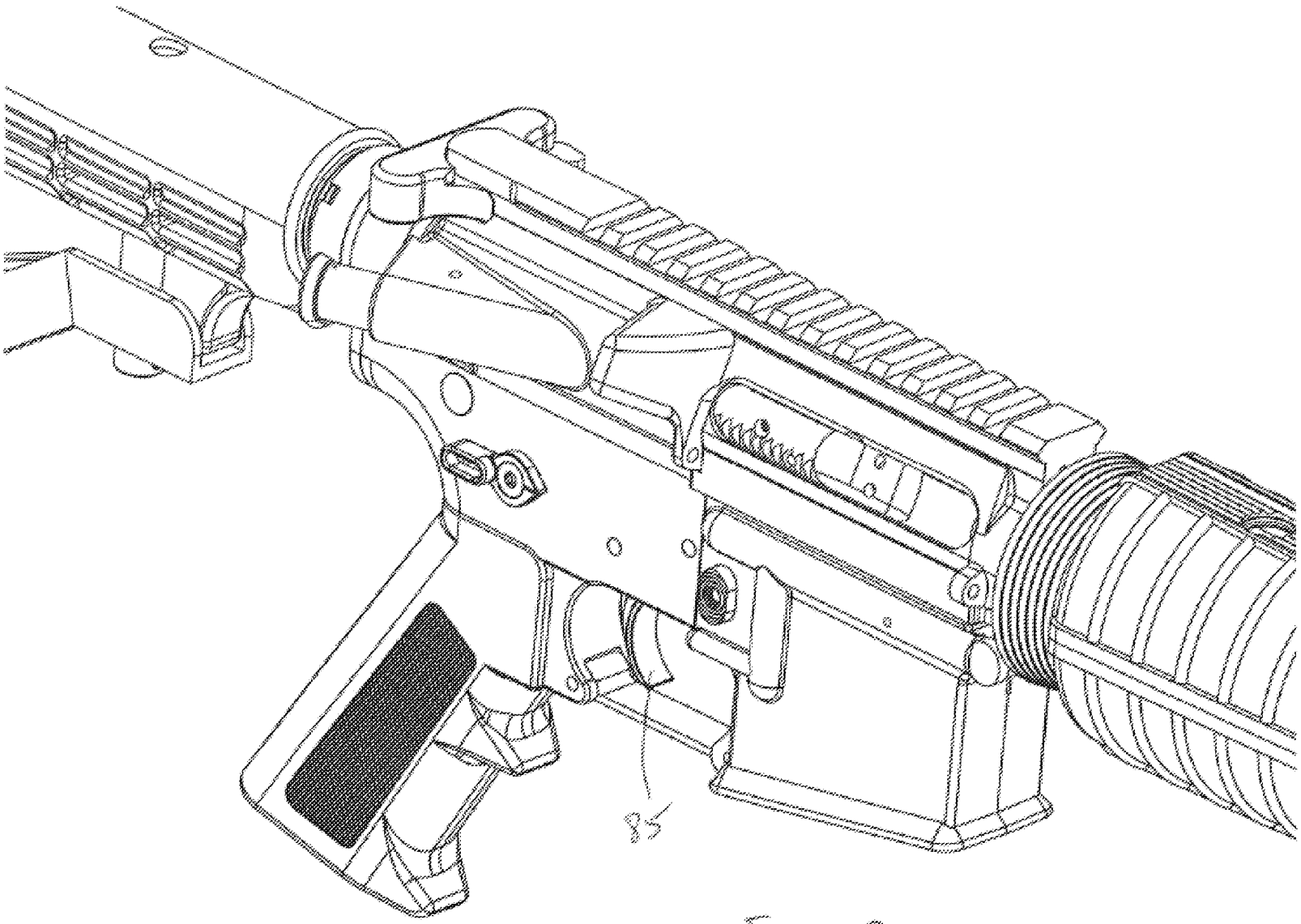
FIG. 2 depicts a partial view of a firearm according to some embodiments presently disclosed.
Figure 3:
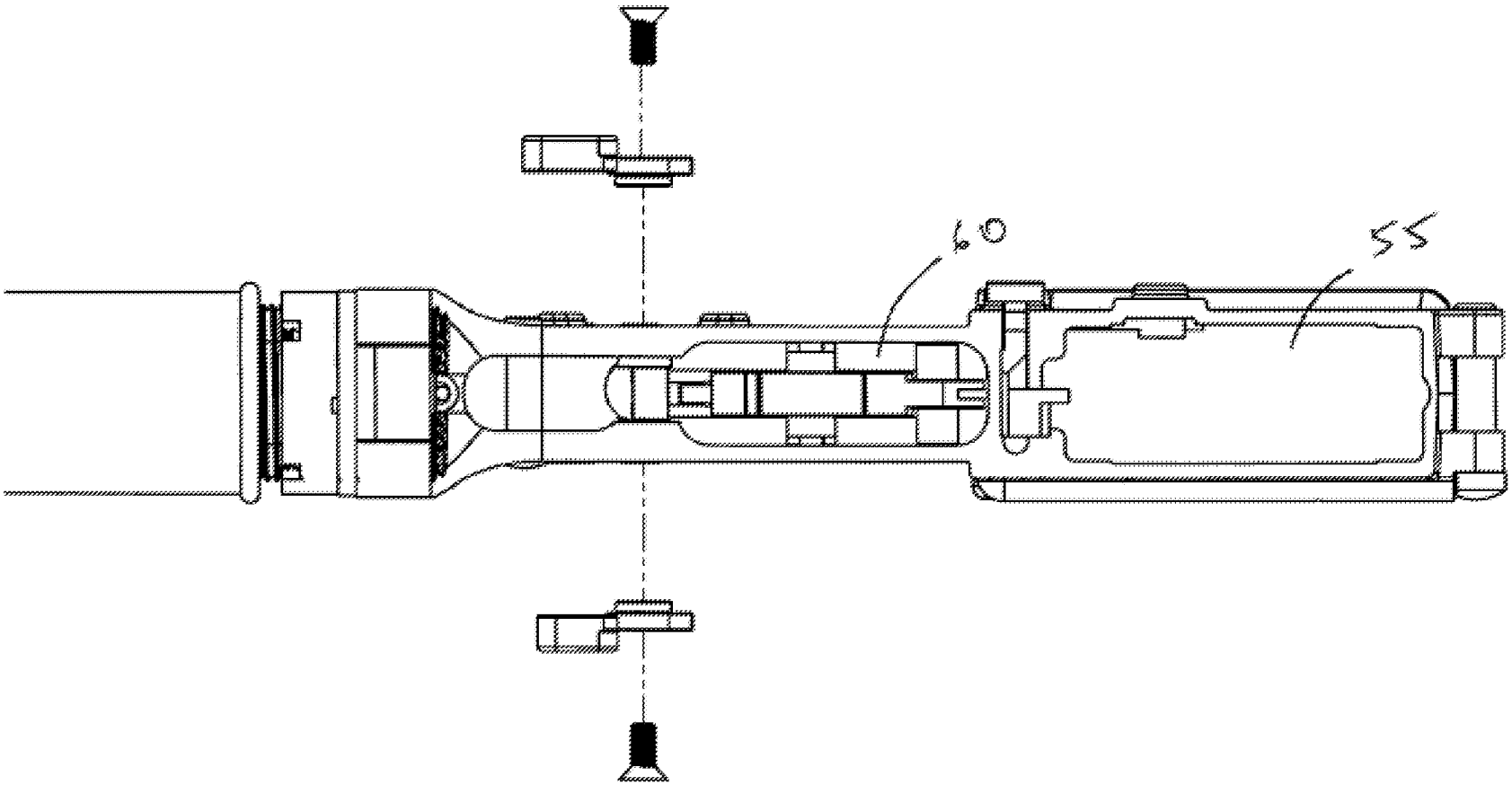
FIG. 3 depicts a top, partial view of a firearm according to some embodiments presently disclosed.
Figure 4:
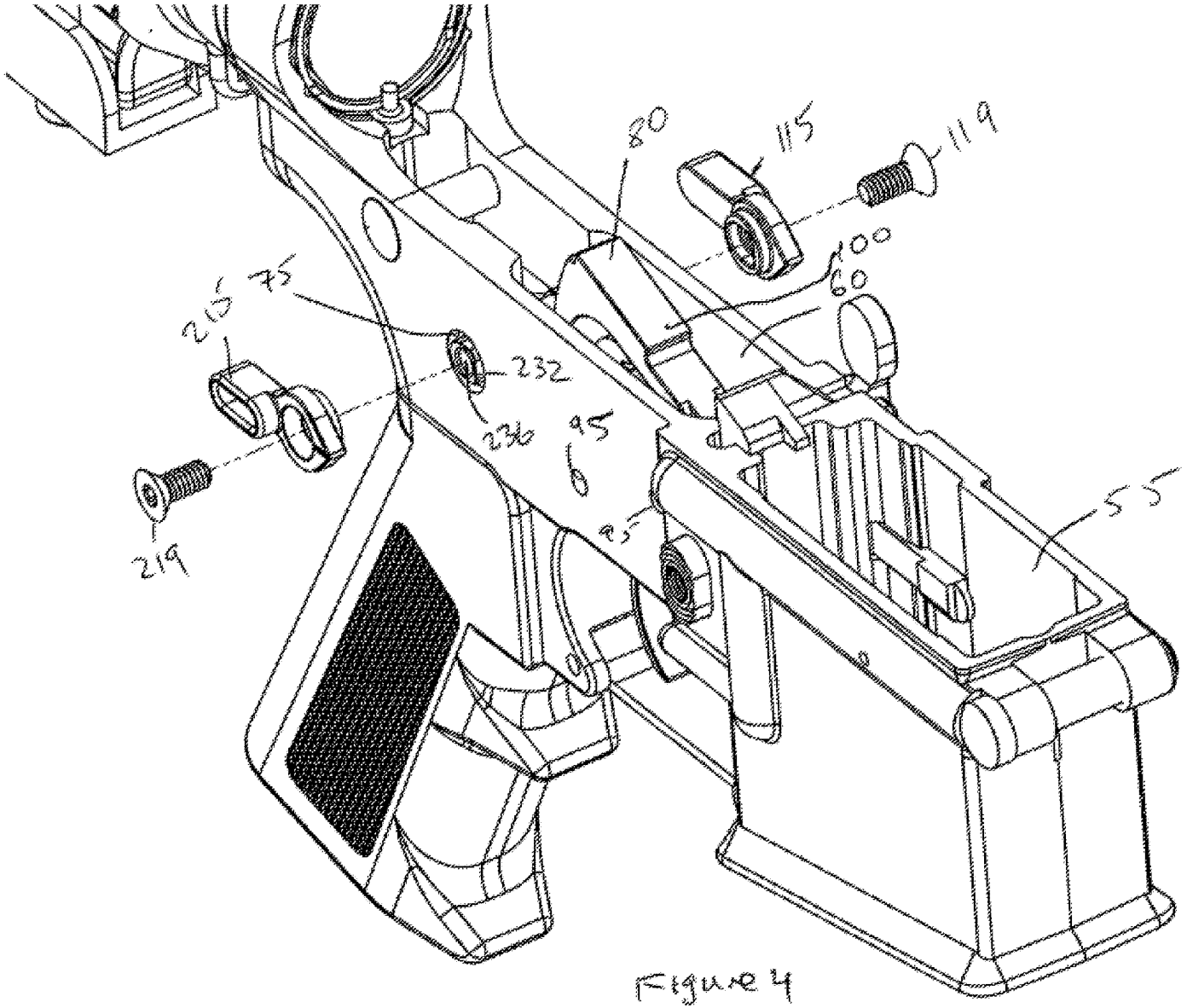
FIG. 4 depicts an exploded, partial view of a firearm according to some embodiments presently disclosed.
Figure 5:
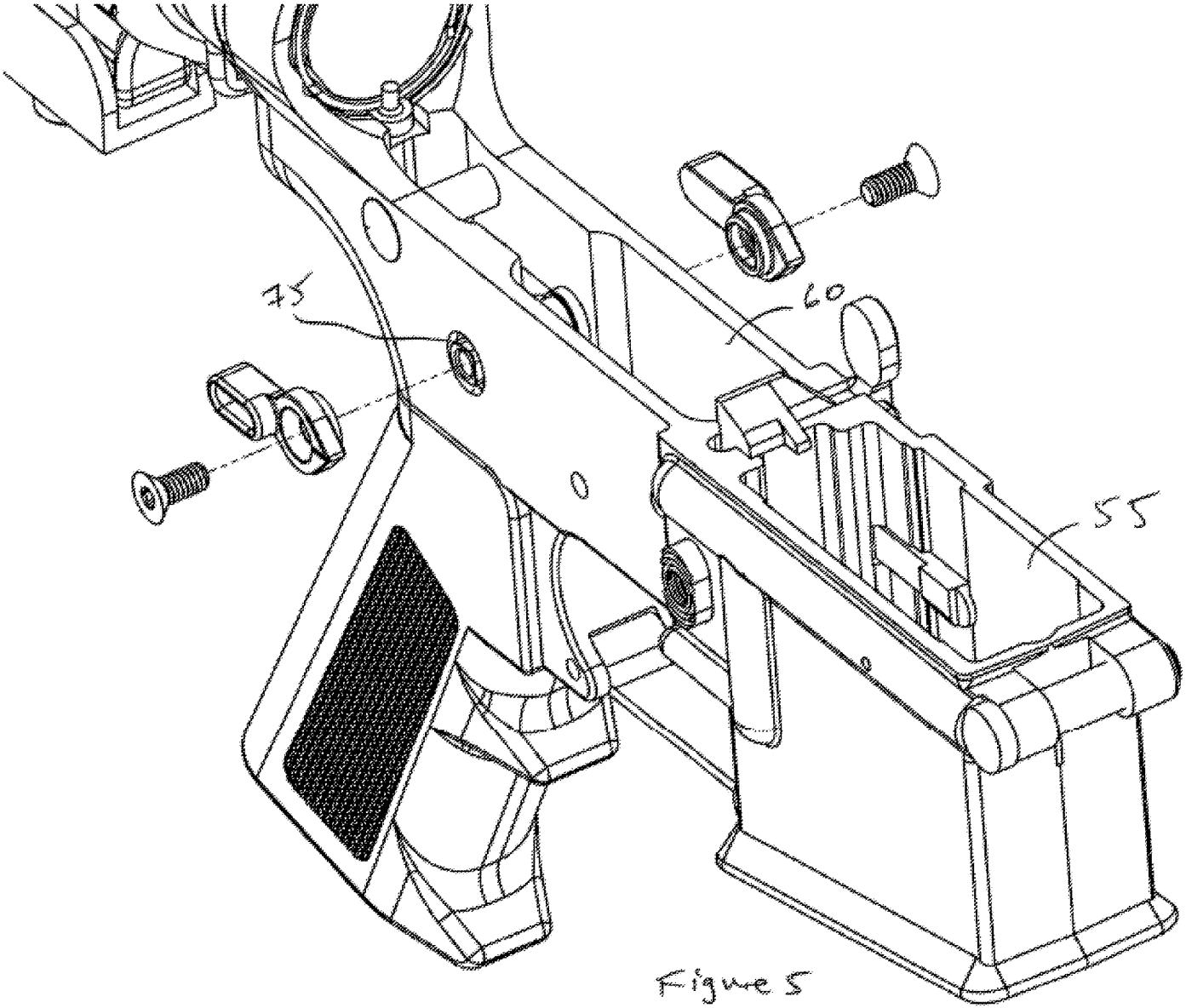
FIG. 5 depicts another exploded, partial view of a firearm according to some embodiments presently disclosed.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring to FIGS. 1-5, there is shown, a lower receiver 50 of a firearm 10 in accordance with some embodiments presently disclosed. According to some embodiments presently disclosed, the lower receiver 50 comprises openings for accepting the internal mechanisms required to operate the firearm. For example, the lower receiver may comprise a magazine well 55 adapted to receive and hold an ammunition magazine (not shown). The lower receiver 50 may also comprise an opening 60 configured to accommodate a firing mechanism 80.

The firing mechanism 80 is capable of operation at least in a SEMI-AUTOMATIC mode. The firing mechanism 80 may also be placed in a SAFE mode. The lower receiver 50 has a fire control assembly 70 (shown in FIGS. 6-7) allowing a user to select the mode of operation of the firing mechanism 80. The fire control assembly 70 is provided in bore 75 (shown in FIGS. 4-5) of lower receiver 50 with a detent (not shown) and detent spring (not shown).

Figure 6:
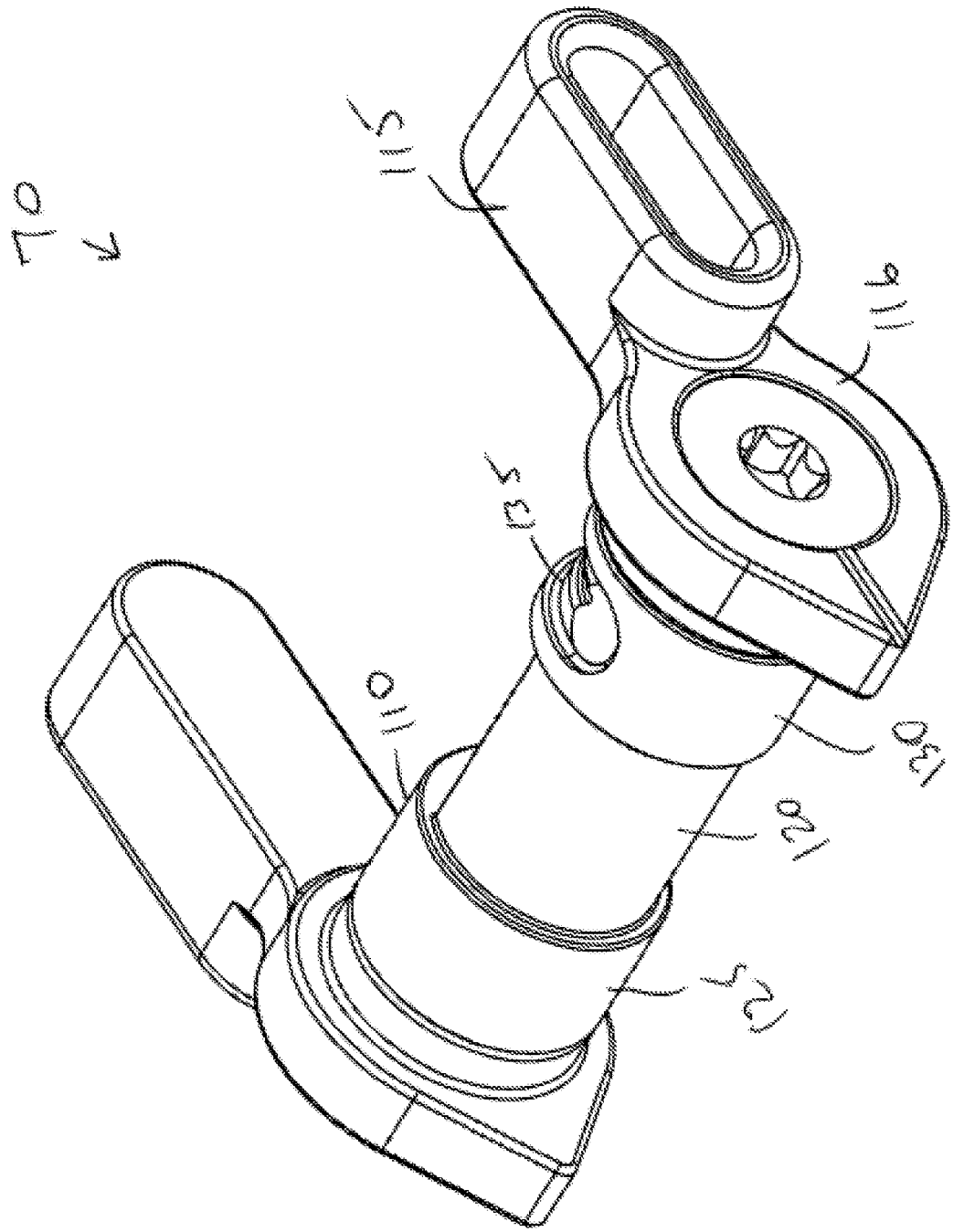
FIG. 6 depicts a fire control assembly according to some embodiments presently disclosed.
Figure 7:
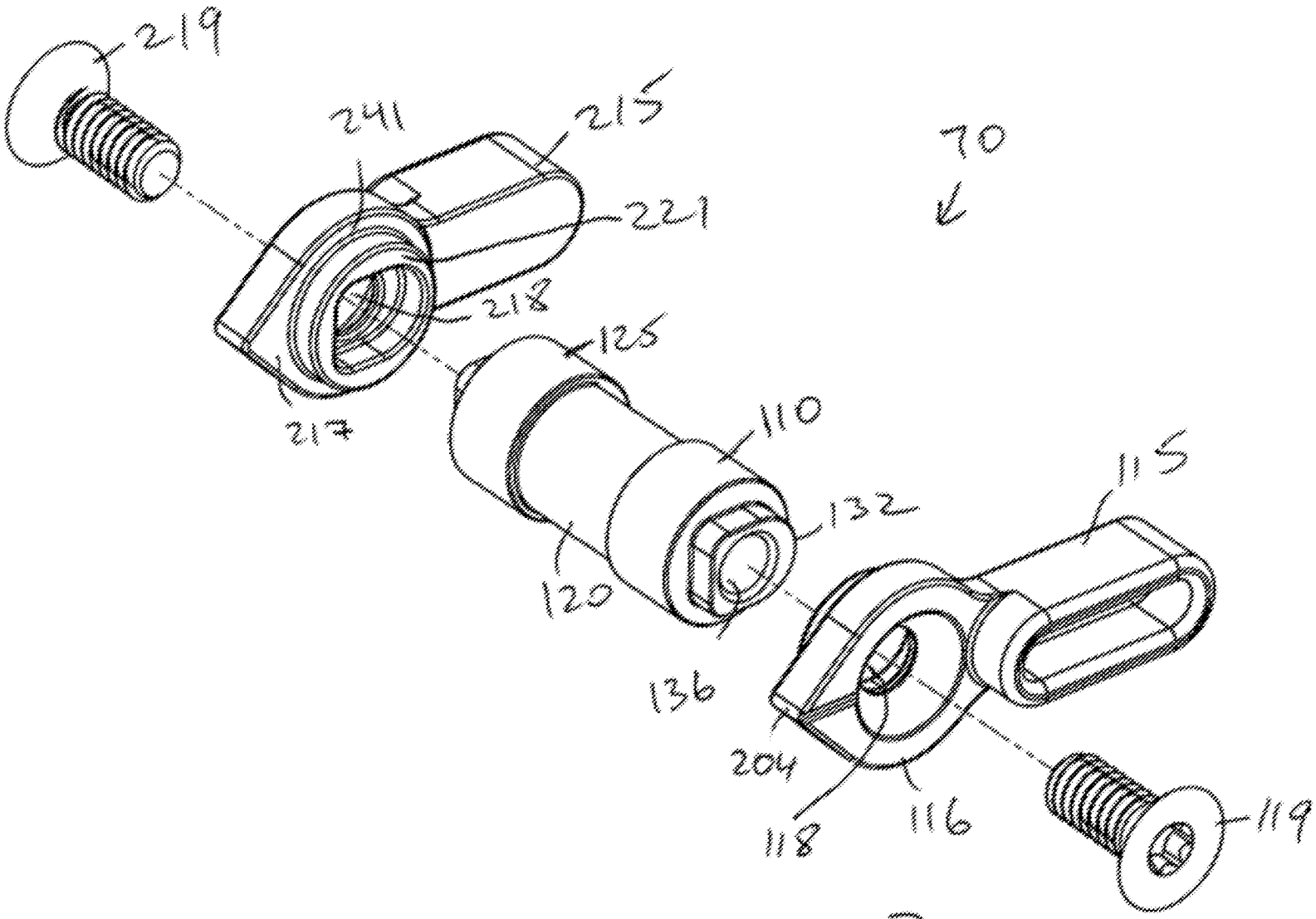
FIG. 7 depicts an exploded view of a fire control assembly according to some embodiments presently disclosed.

Referring now to FIG. 6, there is shown an assembled view of the fire control assembly 70 according to some embodiments presently disclosed. Referring now to FIG. 7, there is shown an exploded view of the fire control assembly 70 shown in FIG. 6. According to some embodiments presently disclosed, the fire control assembly 70 has a pivotable shaft 110 and a selector member 115.

According to some embodiments presently disclosed, the shaft 110 comprises a camming portion or surface 120 and a support portion(s) 125, 130. The support portions 125, 130 may have a common diameter. The support portions 125, 130 may have different diameters.

Figure 9:
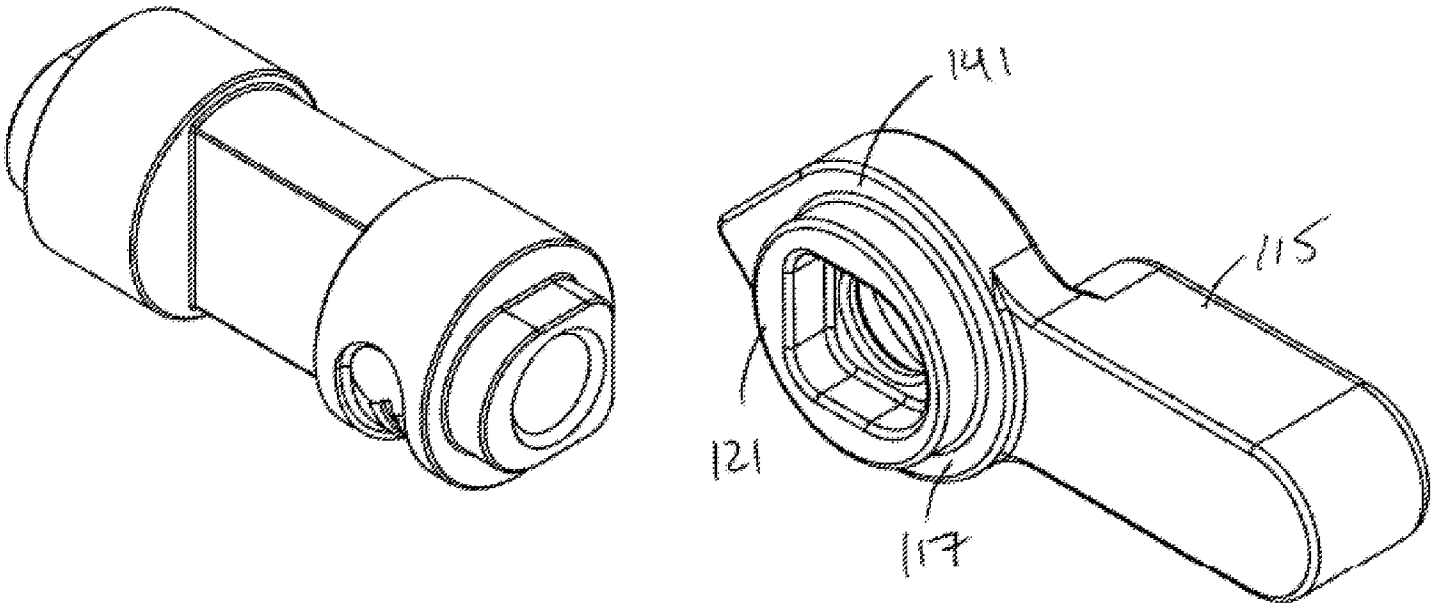
FIG. 9 depicts a fire control assembly according to some embodiments presently disclosed.
Figure 10:
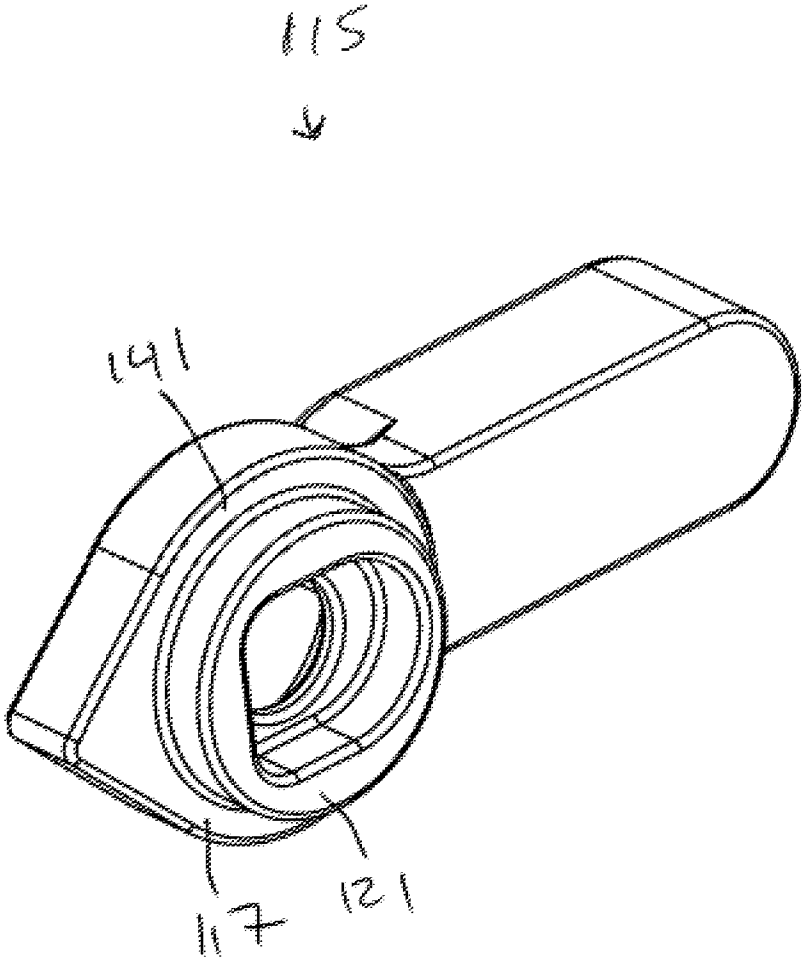
FIG. 10 depicts a selector member according to some embodiments presently disclosed.

According to some embodiments presently disclosed, the selector member 115 comprises a front surface 116 (shown in FIGS. 6-7) positioned away from the lower receiver 50 and a rear surface 117 (shown in FIG. 9) positioned adjacent with the lower receiver 50. According to some embodiments presently disclosed, the selector member 115 comprises a rear edge 141 (shown in FIG. 9) configured to abut a portion of the lower receiver 50. The selector member 115 further comprises a fastener through aperture 118 configured to accommodate a fastener 119. The fastener 119 may be a pin, a screw, a set screw, a full dog point set screw, or a dogleg set screw. The selector member 115 further comprises a first protrusion 121 (shown in FIG. 9) extending towards the lower receiver 50. According to some embodiments presently disclosed, the first protrusion 121 extends from the rear surface 117. The protrusion 121 envelops the support portion 130 and the protrusion 121 acts as supporting surfaces and support the fire control assembly 70 in the bore 75 (shown in FIGS. 3-5) of lower receiver 50. According to some embodiments presently disclosed, the selector member 115 may be formed using polymer to reduce friction with the bore 75 of the lower receiver 50.

According to some embodiments presently disclosed, the support portion 130 comprises a protrusion 132 (shown in FIGS. 7-8) with a fastener aperture 136 bored into the shaft 110. The fastener aperture 136 is configured to accommodate the fastener 119. The protrusion 132 may be D-shaped. The protrusion 121 may be D-shaped to accommodate and envelop the protrusion 132.

According to some embodiments presently disclosed, the selector member 115 is coupled with the support portion 130 using the fastener 119 so as to position the protrusion 121 over the protrusion 132.

According to some embodiments presently disclosed, the camming portion 120 of the fire control assembly 70 is a trigger camming surface 120. The shaft 110 having camming portion 120 may be cast of metal with the sections cast therein, however in alternate embodiments such sections or the part itself could be cut or machined in one part out of a billet of material if desired.

Figure 8:
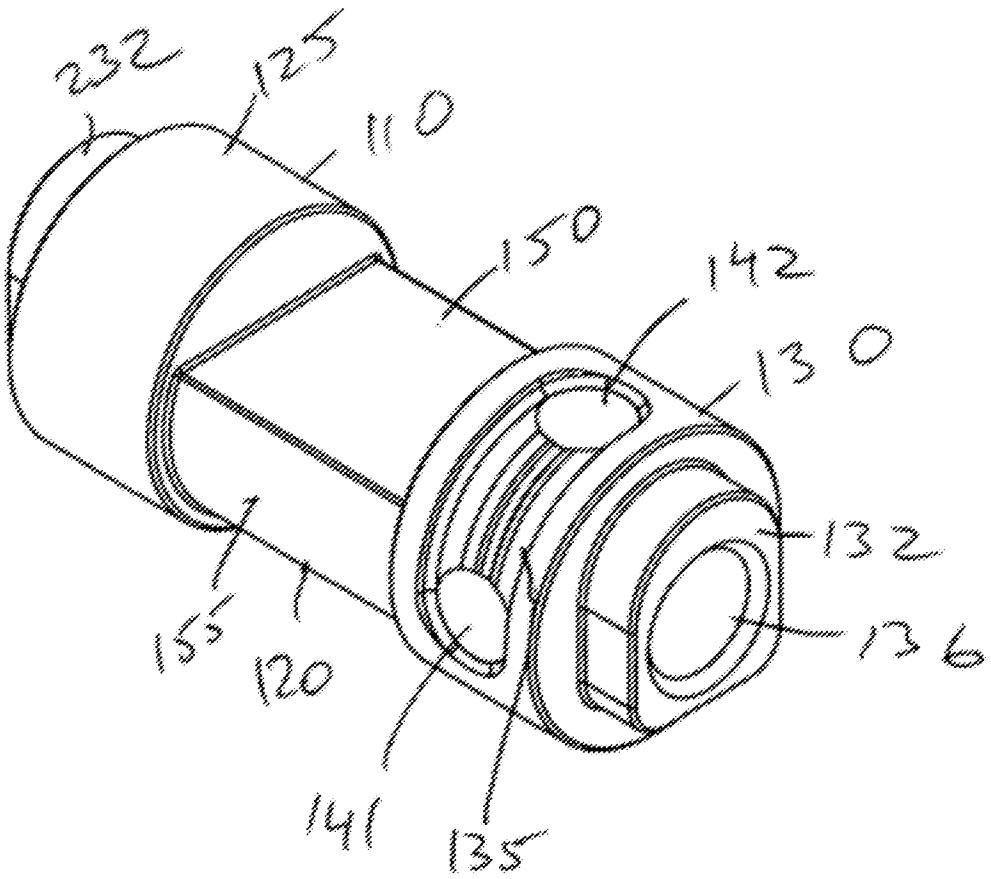
FIG. 8 depicts a pivotable shaft according to some embodiments presently disclosed.

According to some embodiments presently disclosed, the shaft 110 comprises a selector positioning or indexing feature 135 (shown in FIG. 8). The selector position feature 135 may be provided on the support portion 130 adjacent to the selector member 115 (shown in FIG. 6) or it may be provided on the support portion 125 (not shown) at an opposite end of the shaft 110 from the selector member 115. The selector positioning feature 135 engages spring loaded detent (not shown). According to some embodiments presently disclosed, the positioning feature 135 comprise indexing or detent engagement locations (i.e. recesses) 141 and 142 (shown in FIG. 8). The detent engagement locations 141 and 142 provide the fire control assembly 70 with an indexer for holding the shaft 110 in each selector position (e.g. "SAFE", "SEMI-AUTOMATIC"). The detent engagement locations 141 and 142 are adapted to be engaged by the detent or moveable plunger (not shown) for holding the shaft 110 in each selectable position (e.g. "SAFE", "SEMI-AUTOMATIC"). According to some embodiments presently disclosed, the detent engagement recesses 141 and 142 are generally rounded/conical to complement a rounded/conical plunger (not shown). According to some embodiments presently disclosed, the detent engagement recesses 141 and 142 may have any other desired shape.

According to some embodiments presently disclosed, selector positioning feature 135 is located around circumference of the support portion 130 (shown in FIG. 8) to position the shaft 110 in "SAFE" and/or "SEMI-AUTOMATIC" modes. Hence, the circumferential pitch between adjacent detent engagement recesses 141 and 142 is the same as the rotational separation between selector positions. According to some embodiments presently disclosed, selector positioning feature 135 is located around circumference of the support portion 125 (not shown) to position the shaft 110 in "SAFE" and/or "SEMI-AUTOMATIC" modes. Hence, the circumferential pitch between adjacent detent engagement recesses 141 and 142 is the same as the rotational separation between selector positions.

According to some embodiments, the firing mechanism 80 may comprise a trigger 85 with trigger spring (not shown), a disconnector (not shown), disconnector spring (not shown), and a hammer 100 with hammer spring (not shown) disposed in the opening 60 of the lower receiver 50 on pins 95.

According to some embodiments presently disclosed, the hammer 100 (shown in FIG. 4) is pivotally mounted with pin 95 to the lower receiver 50, the trigger 85 is pivotally mounted to the lower receiver 50 with another pin 95. In alternate embodiments the hammer 100 and trigger 85 may be movably mounted to the lower receiver 50 in any other desired manner.

The trigger camming surface 120 may be arranged so that when the fire control assembly 70 is installed in a lower receiver 50, the trigger camming surface 120, upon selection of a desired mode of operation with the selector member 115, is positioned relative to trigger 85 to place the firearm in an operation mode corresponding to the selection. The trigger camming surface 120 is formed to be positioned for engagement and disengagement of the trigger 85, thereby giving effect to the selector positions that may be about 90° apart. It is to be understood that other selector position angles may be provided.

According to some embodiments presently disclosed, the camming surface 120 has a first surface 150 (shown in FIG. 8) and a second surface 155 (shown in FIG. 8) rotatably positioned adjacent to the trailing leg (not shown) of the trigger 85 when the shaft 110 is in a "SEMI-AUTOMATIC" position and "SAFE" position. According to some embodiments presently disclosed, the first surface 150 may be a flat surface spaced away from the trailing leg of the trigger 85 to allow the trailing leg of the trigger 85 to move in the first direction. According to some embodiments presently disclosed, the second surface 155 may be a semicircular surface positioned adjacent with the trailing leg of the trigger 85 to prevent and/or limit the movement of the trailing leg in the first direction. Thus the second surface 155 may limit axial rotation of the trigger 85 at the rear portion on pin 95 in the first direction.

According to some embodiments presently disclosed, the second surface 155 may be a semicircular surface abutting the trailing leg of the trigger 85 to prevent the movement of the trailing leg move in the first direction.

When the camming surface 120 is rotated to the "SEMI-AUTOMATIC" position, there is a space between the surface 150 and the end portion of the trigger 85. This allows the trigger to be pulled to release hammer 100 and leaves disconnect free to engage hammer 100 after the trigger 85 has been pulled. With the fire control selector in the "SAFE" position shown, the end portion of trigger 85 may contact the surface 155 of camming surface 120. This limits the rotation of the trigger 85, which locks the main sear on the trigger 85 in position engaging catch of the hammer 100. In this position, the trigger 85 can not be pulled sufficiently to release hammer 100.

According to some embodiments presently disclosed, the selector member 115 is shaped and positioned on the side of the lower receiver 50 to allow user operation (e.g. toggle) of the selector member 115 with fingers (e.g. the thumb) on the same hand as that with which the user is pulling the trigger 85 (i.e. the trigger hand). According to some embodiments presently disclosed, the selector member 115 has an elongated tab shape and extends rearwards from the selector pivot axis and is rotated to effect selection of the fire control positions of the fire control assembly 70. In this embodiment, the fire control assembly 70 is capable of ambidextrous operation, and may be rotated using the selector member 115. The selector member 115 of the fire control assembly 70 may have for example a pointer 204 or other suitable indicator that points to or otherwise indicates a indicated position that corresponds with the selected position of the fire control assembly 70.

According to some embodiments presently disclosed, the fire control assembly 70 comprises another (i.e. second) selector member 215 (shown in FIG. 7). The second selector member 215 comprises a front surface positioned away from the lower receiver 50 and a rear surface 217 positioned adjacent with the lower receiver 50. According to some embodiments presently disclosed, the selector member 215 comprises a rear edge 241 configured to abut the lower receiver 50. The selector member 215 further comprises a fastener through hole 218 configured to accommodate a fastener 219. The fastener 219 may be a pin, a screw, a set screw, a full dog point set screw, or a dogleg set screw. The selector member 215 further comprises a first protrusion 221 extending towards the lower receiver 50. According to some embodiments presently disclosed, the first protrusion 221 extends from the rear surface 217. The protrusion 221 envelops the support portion 125 and the protrusion 221 acts as supporting surfaces and support the fire control assembly 70 in the bore 75 (shown in FIGS. 3-5) of lower receiver 50. According to some embodiments presently disclosed, the selector member may be formed using polymer to reduce friction with the bore 75 of the lower receiver 50.

According to some embodiments presently disclosed, the support portion 125 comprises a protrusion 232 (shown in FIGS. 4 and 8) with a fastener aperture 236 bored into the shaft 110. The fastener aperture 236 is configured to accommodate a fastener 219. The protrusion 232 may be D-shaped. The protrusion 221 may be D-shaped to accommodate and envelop the protrusion 132.

According to some embodiments, the fire control assembly 70 is used on AR type of rifles. According to some embodiments, the fire control assembly 70 is used on AR type of rifles with blowback.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A fire control assembly comprising:

a pivotable shaft comprising a first end and a second end; and a first selector member removably coupled with the first end of the pivotable shaft;

wherein the first selector comprises a rear edge for abutting a lower receiver;

wherein the first selector comprises a first protrusion configured to partially envelop the first end of the pivotable shaft;

wherein the first protrusion extends from the rear edge;

wherein the first selector member is configured to rotate the pivotable shaft from a safe position to a firing position and back to the safe position.

2. The fire control assembly of claim 1, wherein the first protrusion comprises an aperture configured to accommodate the first end of the pivotable shaft.

3. The fire control assembly of claim 2, wherein the aperture is D-shaped.

4. The fire control assembly of claim 3, wherein the first end of the pivotable shaft comprises a second protrusion configured to be enveloped by the first protrusion.

5. The fire control assembly of claim 4, wherein the second protrusion is D-shaped.

6. The fire control assembly of claim 1, wherein the first selector comprises an aperture configured to accommodate a fastener.

7. The fire control assembly of claim 6, wherein the pivotable shaft comprises another aperture configured to accommodate the fastener.

8. The fire control assembly of claim 7, wherein the fastener is positioned within the aperture and the another aperture.

* * * * *